US011628984B2

(12) United States Patent
Kieras et al.

(10) Patent No.: US 11,628,984 B2
(45) Date of Patent: Apr. 18, 2023

(54) PIERCEABLE CLOSURE VALVE ASSEMBLY

(71) Applicant: Liqui-Box Corporation, Richmond, VA (US)

(72) Inventors: Ronald E. Kieras, McHenry, IL (US); Matthew Ruschmeier, Glencoe, MN (US)

(73) Assignee: Liqui-Box Corporation, Richmond, VA (US)

( * ) Notice: Subject to any disclaimer, the term of this patent is extended or adjusted under 35 U.S.C. 154(b) by 0 days.

(21) Appl. No.: 17/694,795

(22) Filed: Mar. 15, 2022

(65) Prior Publication Data

US 2022/0297901 A1 Sep. 22, 2022

Related U.S. Application Data

(60) Provisional application No. 63/161,658, filed on Mar. 16, 2021.

(51) Int. Cl.
*B65D 47/14* (2006.01)
*B65D 47/36* (2006.01)
(Continued)

(52) U.S. Cl.
CPC ..... *B65D 47/147* (2013.01); *B65D 47/36* (2013.01); *B65D 51/002* (2013.01);
(Continued)

(58) Field of Classification Search
CPC .... B65D 47/147; B65D 47/36; B65D 51/002; B65D 51/221; B65D 77/40; B65D 2547/066
(Continued)

(56) References Cited

U.S. PATENT DOCUMENTS 3,592,351 A * 7/1971 Johnson, Jr. ..... B65D 51/002 222/82
7,357,277 B2 * 4/2008 Verespej ..... B65D 51/20 222/153.01
(Continued)

FOREIGN PATENT DOCUMENTS

WO WO-2008014605 A1 * 2/2008 ..... B65D 75/5877

OTHER PUBLICATIONS

PCT, Notification of Transmittal of the International Search Report and the Written Opinion of the International Searching Authority, or the Declaration, in International Application No. PCT/US2022/020298, dated Jul. 4, 2022 (12 pages).

*Primary Examiner* — Patrick M. Buechner
*Assistant Examiner* — Michael J. Melaragno
(74) *Attorney, Agent, or Firm* — McAndrews, Held & Malloy, Ltd.

(57) ABSTRACT

The present application relates to a closure assembly for connection to a spout in fluid communication with a container. The closure assembly includes a housing configured to be secured to the spout and including a fluid passageway and a piercable membrane in the fluid passageway. The closure assembly includes a retention member configured to be secured to the housing and a flexible valve that is positioned in the fluid passageway of the housing and that is secured to the housing by the retention member. The closure assembly is configured to receive a piercing element that extends into the housing such that the piercing member can pierce the valve and the membrane, and the retention member has locking elements that engage the piercing element to lock the piercing element in place with respect to the assembly.

18 Claims, 6 Drawing Sheets

(51) Int. Cl.
*B65D 51/00* (2006.01)
*B65D 51/22* (2006.01)
*B65D 77/40* (2006.01)

(52) U.S. Cl.
CPC ..... *B65D 51/221* (2013.01); *B65D 77/40* (2013.01); *B65D 2547/066* (2013.01)

(58) Field of Classification Search
USPC ..... 222/81
See application file for complete search history.

(56) References Cited

U.S. PATENT DOCUMENTS 7,980,424 B2 * 7/2011 Johnson ..... B67B 7/26 222/105
8,413,857 B2 * 4/2013 Johnson ..... B65D 75/5877 222/105
9,434,516 B2 * 9/2016 Johnson ..... B67D 7/0294
9,862,531 B2 * 1/2018 Johnson ..... B65D 75/5877
10,227,167 B2 * 3/2019 Darby ..... B65D 77/067
10,618,703 B2 * 4/2020 Darby ..... B65D 77/065
11,142,377 B2 * 10/2021 Johnson ..... B65D 47/2031
11,319,119 B2 * 5/2022 Darby ..... B65D 77/065
2006/0249533 A1 * 11/2006 Verespej ..... B65D 47/0814 222/153.01
2007/0205216 A1 * 9/2007 Smith ..... B65D 51/226 222/81
2010/0122991 A1 * 5/2010 Taguchi ..... B65D 47/061 222/83
2010/0176152 A1 * 7/2010 Johnson ..... B65D 75/5877 137/846
2011/0017774 A1 * 1/2011 Pritchard ..... G01F 11/08 222/207
2012/0031923 A1 * 2/2012 Smith ..... B65D 47/2031 222/107
2016/0249765 A1 * 9/2016 Perrin ..... A47J 31/4496 222/129.4
2016/0376139 A1 * 12/2016 Melville, Jr. ..... B65D 85/804 222/1
2018/0079564 A1 * 3/2018 Darby ..... B65D 77/067
2018/0244440 A1 * 8/2018 Beilke ..... B65D 47/0804
2019/0152657 A1 * 5/2019 Darby ..... B65D 85/80
2020/0172302 A1 * 6/2020 Darby ..... B65D 47/068
2022/0135295 A1 * 5/2022 Ruschmeier ..... B67D 3/0067 222/1
2022/0135392 A1 * 5/2022 Kieras ..... B67D 3/047 222/548

* cited by examiner

PIERCEABLE CLOSURE VALVE ASSEMBLY

This application is related to, and claims priority to, U.S. Provisional Application No. 63/161,658, filed Mar. 16, 2021, titled "Pierceable Closure Valve Assembly," the complete subject matter and contents of which is incorporated herein by reference in its entirety.

BACKGROUND

Generally, this application relates to a closure valve assembly for a container and preferably a pierceable closure assembly including a seal cap and valve for use with a flexible food container.

Collapsible plastic bags are often used to store liquid products such as chemicals, soft drink syrup, fruit juices, dairy, dairy blends, smoothies and food condiments. The plastic bags are typically housed in a corrugated paperboard box to aid in the transporting, handling and dispensing of the product. Such packaging systems are commonly referred to as "bag-in-box" packaging systems.

The plastic bags typically have sidewalls sealed along a peripheral seam to define a fluid containing chamber. An access member such as a fitment or spout associated with the bag provides fluid communication with the contents of the bag. The access member can be an assembly for connecting the access member to a fluid transfer line that can remove the contained products under vacuum pressure in aseptic or non-aseptic fashion.

SUMMARY

Certain embodiments of the present technology relate to a closure assembly for connection to a spout in fluid communication with a container. The closure assembly includes a housing configured to be secured to the spout and including a fluid passageway and a pierceable membrane in the fluid passageway. The closure assembly further includes a retention member configured to be secured to the housing and a flexible valve that is positioned in the fluid passageway of the housing and that is secured to the housing by the retention member. The closure assembly is configured to receive a piercing element that extends into the housing such that the piercing member can pierce the valve and the membrane, and the retention member has locking elements that engage the piercing element to lock the piercing element in place with respect to the assembly.

The closure assembly may also include a seal cap that connects to the retention member to seal the assembly and the seal cap may include a hinged strap that connects the seal cap to the retention member. The piercing element may be retained by the retention member with a tab and bayonet fitting connection. The valve may form a seal on the piercer when the piercer is inserted through the valve. The valve may be positioned between a sloped wall of the retention member and a ridge that is part of a cylindrical wall of the housing that defines the fluid passageway. The housing may include first and second concentric walls that extend from a top portion and that define an annular channel that receives a wall of the spout. At least one of the first and second concentric walls may snapably engage the spout with a projection and detent arrangement in order to secure the spout wall in the annular channel. The retention member may include a cylindrical wall from which extends a projection that snapably engages a detent in the second concentric wall of the housing in order to secure the retention member to the housing.

Certain embodiments of the present technology relate to a system for dispensing fluid. The system includes a flexible container including a spout connected thereto, and the spout is in fluid communication with an interior region of the container. The system includes a housing configured to be mounted to the spout to seal the spout, and the housing includes a fluid passageway. The system includes a retention member configured to be secured to the housing. The system includes a flexible valve that is positioned in the fluid passageway of the housing and that is secured to the housing by the retention member. The system includes a piercing element having a first end that is configured to puncture the valve and the membrane and a second end configured to be connected to a dispensing element. The piercing element is inserted into the housing such that the first end punctures the membrane and valve and such that the piercing element is locked with respect to the retention member so that fluid can flow from the interior region into the piercing element.

The system may further include a seal cap that connects to the retention member, and the seal cap includes a hinged strap that connects the seal cap to the retention member. The piercing element may be retained by the retention element with a tab and bayonet fitting connection. The valve may form a seal on the piercer when the piercer is inserted through the valve. The valve may be positioned between a sloped wall of the retention member and a ridge that is part of a cylindrical wall of the housing that defines the fluid passageway. The housing may include first and second concentric walls that extend from a top portion and that define an annular channel that receives a wall of the spout. At least one of the first and second concentric walls may snapably engage the spout with a projection and detent arrangement in order to secure the spout wall in the annular channel. The retention member may include a cylindrical wall from which extends a projection that snapably engages a detent in the second concentric wall of the housing in order to secure the retention member to the housing.

Figure 1:
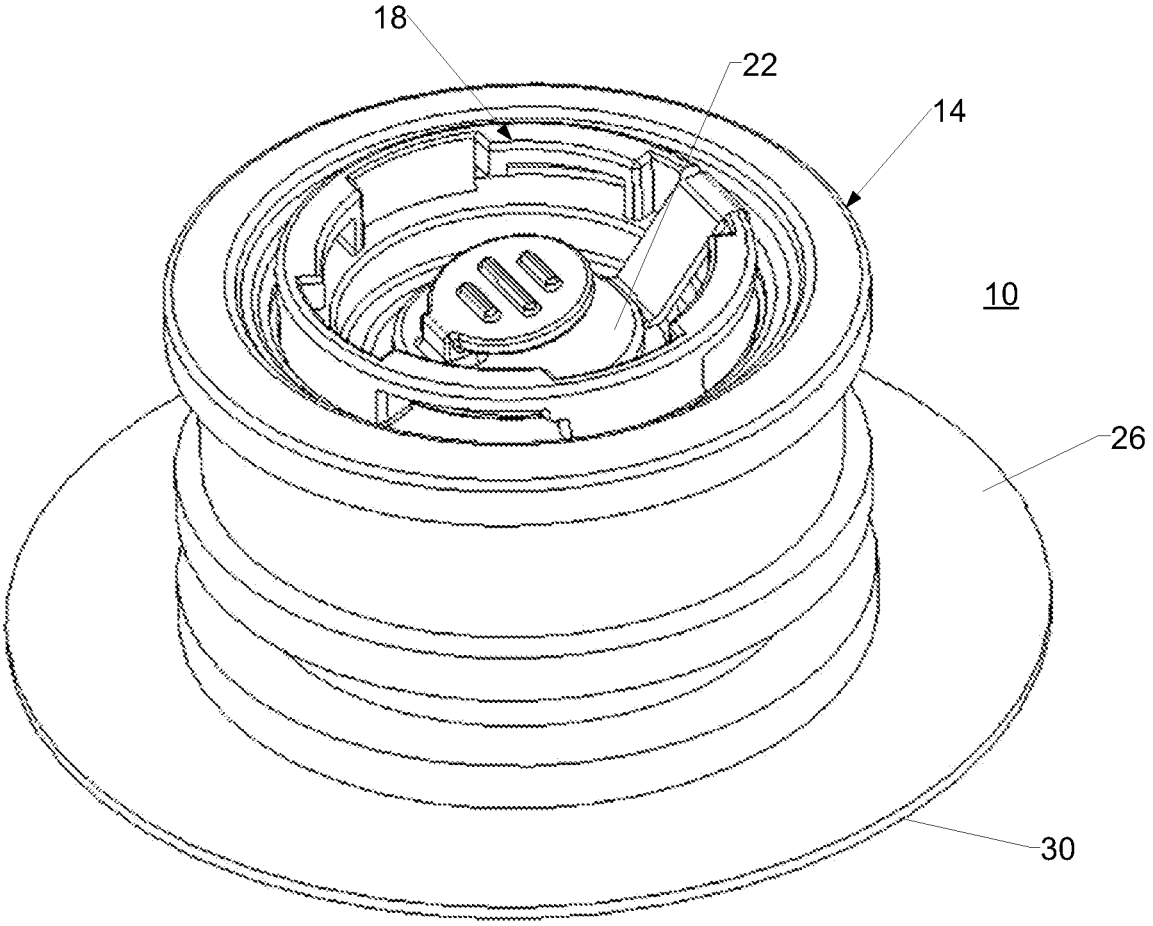
FIG. 1 illustrates an isometric view of a closure assembly on a spout according to an embodiment of the present technology.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIG. 1 illustrates an isometric view of a container closure assembly 10 having a body or housing 14 and a valve retention member 18 and a flip seal cap 22. The assembly 10 is connected to and can include a spout or fitment 26. The spout 26 is configured to be connected to an opening in a flexible container (not shown), such as a plastic bag or pouch. The spout 26 has a flange 30 that can be connected to the container by a heat seal or other known means for connecting a spout to a flexible container. When connected to the container, the spout 26 is in fluid communication with an interior region of the container. The container can contain any number or kind of fluid products and flowable foods. The container can be filled with and emptied of fluid products through the spout 26.

Figure 2:
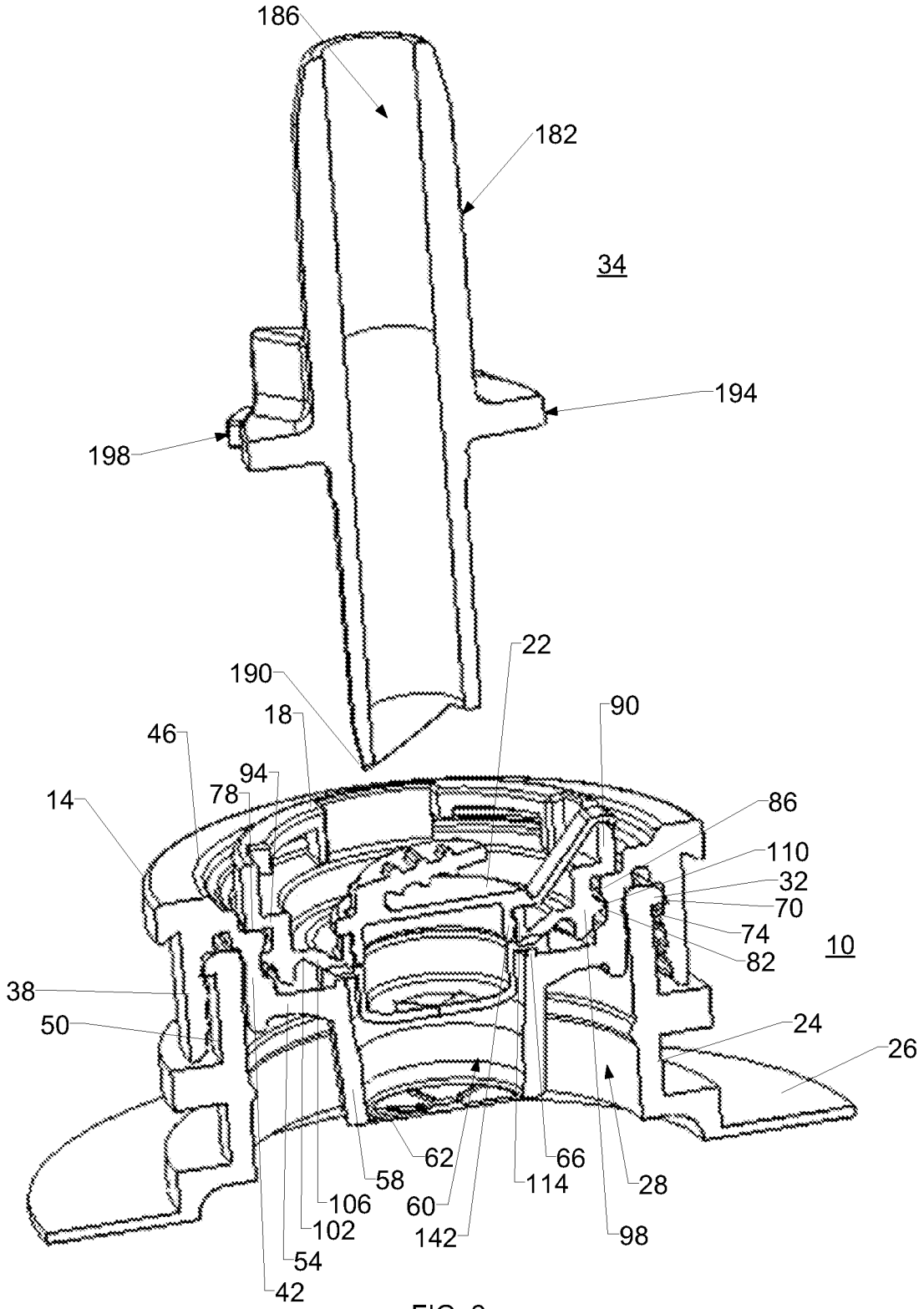
FIG. 2 illustrates a cross-sectional isometric view of the closure assembly and spout of FIG. 1 and a piercer according to an embodiment of the present technology.

FIG. 2 illustrates a cross-sectional side view of the assembly 10 of FIG. 1 and a piercer 34. The spout 26 includes a cylindrical wall 24 that defines a passageway 28 therethrough. An outer flange 32 extends outwardly from the top of the wall 24. The housing 14 is mounted to the spout 26 and extends into the passageway 28. The housing 14 includes two coaxially disposed and radially-spaced, generally first and second cylindrical walls 38 and 42 extending axially away from a top wall surface 46 to define an annular chamber 50 therebetween. A base portion 54 extends radially inwardly from the second cylindrical wall 42, and a third cylindrical wall 58 extends axially away from the base portion 54. The third cylindrical wall 58 defines a passageway 60, and a pierceable membrane 62 extends along the bottom of the third cylindrical wall 58. The third wall 58 extends over and above the base portion 54 to define a circular ridge 66. The first cylindrical wall 38 includes a detent or radial slot 70 on the inner side thereof that defines the annular chamber 50. Beneath the detent 70, the first cylindrical wall 38 may also have an annular projection 74 that extends inwardly into the chamber 50. At the top of the second cylindrical wall 42 is a circular engagement surface 78. The second cylindrical wall 42 includes a detent or radial slot 82 on the inner side thereof. Above the detent 82, the second cylindrical wall 42 may also have an inwardly extending annular projection 86.

The retention member 18 includes a top, outer (or first) cylindrical wall or collar 90. A first inner flange 94 extends inwardly from the bottom of the top cylindrical wall 90. A middle (or second) cylindrical wall 98 extends downward from the inner flange 94. A second inner flange 102 extends inwardly from the bottom of the middle cylindrical wall 98. A sloped or angled wall 106 extends downwardly and inwardly from the flange 102. The sloped wall 106 forms an angle that is greater than 90 degrees with the bottom of the middle flange 102. An annular projection 110 extends outwardly from the outer side of the middle cylindrical wall 98. An inner (or third) cylindrical wall 114 extends upwardly from the bottom of the sloped wall 106.

Figure 3:
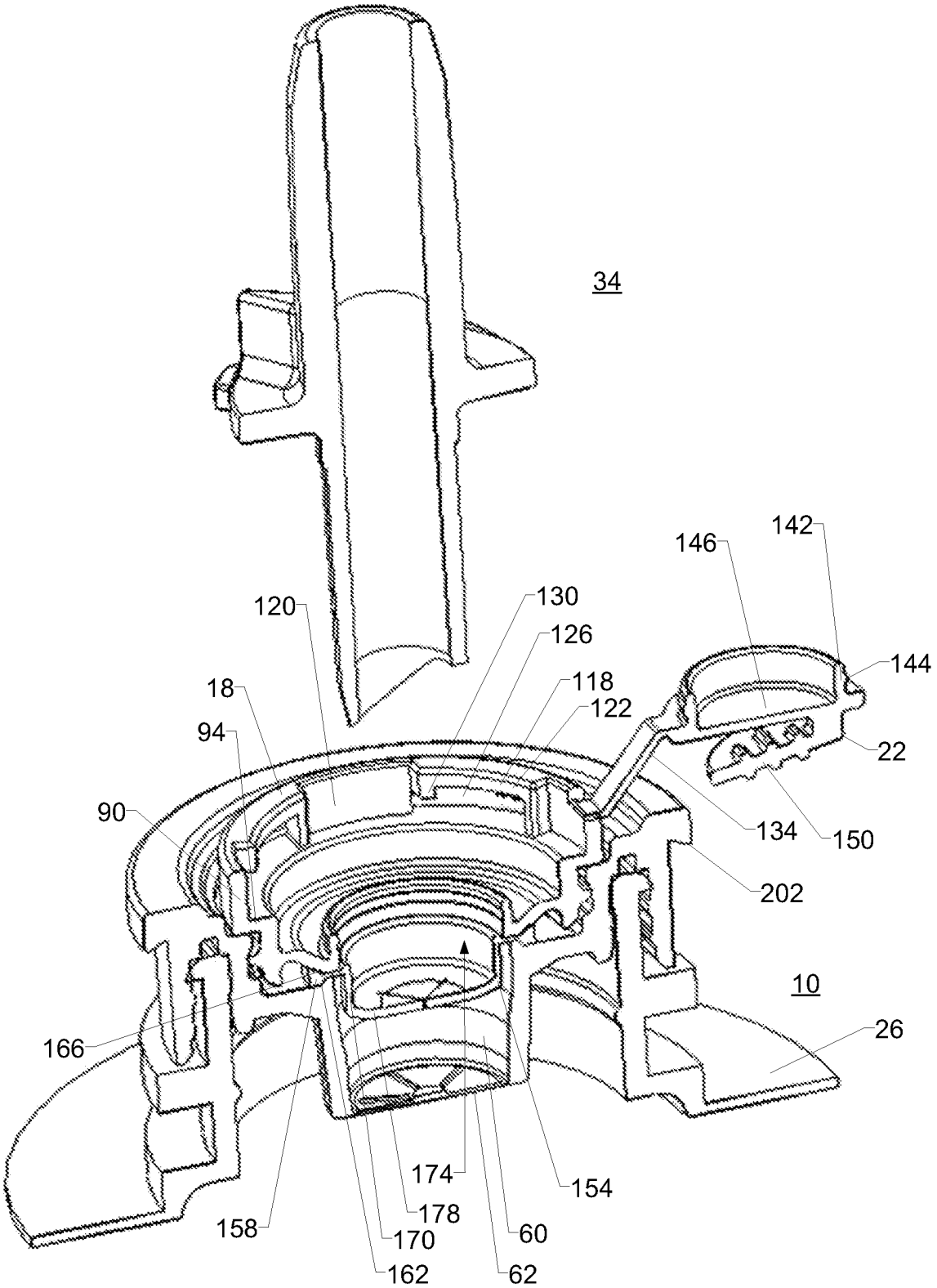
FIG. 3 illustrates another cross-sectional isometric view of the closure assembly, spout, and piercer of FIG. 2 according to an embodiment of the present technology.

With respect to FIG. 3, the collar 90 of the retention member 18 includes a plurality of, e.g., four, equi-spaced bayonet fittings 118. The bayonet fittings 118 each include an L-shaped inwardly extending transversely arranged projection 122 defining a channel 126. A downwardly extending retaining projection 130 is provided on the free end of the stem of the L shaped projection 122 to retain items in the channel 126. The collar 90 includes gaps 120 between the bayonet fittings 118. The retention member inner flange 94 forms the lower surface of the gaps 120. The seal cap 22 can be connected to the retention member 18 by a strap or tether 134, and the strap 134 may be hinged. The seal cap 22 includes a cylindrical wall 142 that extends axially from a circular top portion 146. The cylindrical wall 142 may include one or more sealing ridges 144. The seal cap 22 may further include a grip or handle 150 that may be textured or include ridges to aid a user in grasping the handle 150. In FIG. 2, the seal cap 22 is in a closed, sealed position in which the cylindrical wall 142 is positioned and press fit within the inner cylindrical wall 114 of the retention member 18. When in the closed position, the seal cap 22 seals and closes the assembly 10. The seal may be an aseptic seal formed between inner cylindrical wall 114 and the sealing ridges 144 and/or the cap cylindrical wall. As shown in FIG. 3, the seal cap 22 is in an open position.

Continuing with respect to FIG. 3, the assembly 10 further includes a valve 154. The valve 154 is made out of a flexible, resilient material such as silicone. The valve 154 includes a triangular shaped outer retention portion 158 having a bottom or housing engaging portion 162, and a top or retention member engaging portion 166. A cylindrical wall 170 extends downward from the outer retention portion 158 that defines a passageway 174. A bottom portion or membrane 178 extends across the passageway 174 at the bottom of the wall 170. The bottom portion 178 is a flexible membrane that may be partly or fully scored. The scoring may be in, for example, a cross shape.

As shown in FIGS. 2 and 3, the assembly 10 is fully assembled and connected to the spout 26. In particular, the housing 14 has been snapably connected to the spout 26 by inserting the cylindrical wall 24 of the spout 26 into the annular channel 50 of the housing 14 such that the outer flange 32 of the spout 26 snaps over the annular projection 74 and into the detent 70 on the first cylindrical wall 38 of the housing 14. The interaction of the outer flange 32 and the detent 70 keeps the housing 14 secured to the spout 26. The housing 14 can be detached from the spout 26 by pulling the housing 14 such that the outer flange 32 snaps out of the detent 70 and downward past the annular projection 74.

The valve 154 has been positioned in the housing 14 such that the cylindrical wall 170 is received in the passageway 60 of the housing 14, the housing engaging portion 162 of the valve 154 is positioned on top of the base portion 54 of the housing 14, and the ridge 66 of the housing 14 is positioned in a gap between the housing engaging portion 162 and the cylindrical wall 170 of the valve 154. The valve 154 is secured in place in the assembly 10 by being sandwiched between the housing 14 and the retention member 18. Specifically, the retention member 18 has been inserted inside the second cylindrical wall 42 of the housing 14 such that the annular projection 110 of the retention member 18 snapably slides over the annular projection 86 of the housing 10 and into the detent 82 of the housing's second cylindrical wall 42. The interaction of the annular projection 110 and the detent 82 keeps the retention member 18 secured to the housing 14. The retention member 18 can be detached from the housing 14 by pulling the retention member 18 such that the annular projection 110 snaps out of the detent 82 and past annular projection 86. When the retention member 18 is snapably connected to the housing 14, the bottom of the inner cylindrical wall 114 of the retention member 18 engages the retention member engaging portion 166 of the valve 154 such that the flexible valve 154 is pinched between, and forms a seal with, the housing 14 and the retention member 18. In this way, the valve 154 is secured in the assembly 10.

Prior to the assembly 10 being attached to the spout 26 as shown in FIG. 2, the container to which the spout 26 is connected is filled with fluid product through the spout 26. The spout 26 is then capped with the assembly 10 as shown in FIG. 2. When the end user wishes to withdraw the fluid product from the container, the user may use a dispensing connector like the piercer 34 shown in FIGS. 2 and 3. The piercer or piercing element or piercing tube 34 has a tube shaped body 182 that defines a fluid passageway 186. One end of the piercer 34 has a point or edge 190 that is shaped and configured to pierce the housing membrane 62 and the valve bottom membrane portion 178. The other end of the piercer 34 is configured to be connected to a tube or line that takes fluid to a dispensing station. The tube or line is connected to a pump or vacuum that can create suction in the tube and piercer 34 such that the piercer 34 can extract fluid product from a container. The piercer 34 further includes a flange 194 extending outwardly from the body 182 and that includes at least one tab 198 or a plurality of equi-spaced tabs 198 extending radially outwardly from the flange 194.

As shown in FIG. 3, the seal cap 22 can be moved from the closed position to the open position in order to prepare the assembly 10 for insertion by the piercer 34. A user can move the seal cap 22 by grabbing the handle 150 and pulling the seal cap 22 up and away from the inner cylindrical wall 114 of the retention member 18. The hinged portion of the strap 134 can rest in a gap defined between the collar 90 of the retention member 18 and a top, outer rim 202 of the housing 14. The seal cap 22 can be held in the open position by snapping an end of the handle 150 below a bottom edge of the outer rim 202. Alternatively, the seal cap 22 may not be connected to or integral with the retention member 18 or can be torn off of or detached from the retention member 18, in which case, the seal cap 22 is removed from the retention member 18 and set aside after being moved from the closed position. With the seal cap 22 in the open position, the piercer 34 can start to be lowered toward the assembly 10 in order to be used to withdraw fluid contents from the container.

Figure 4:
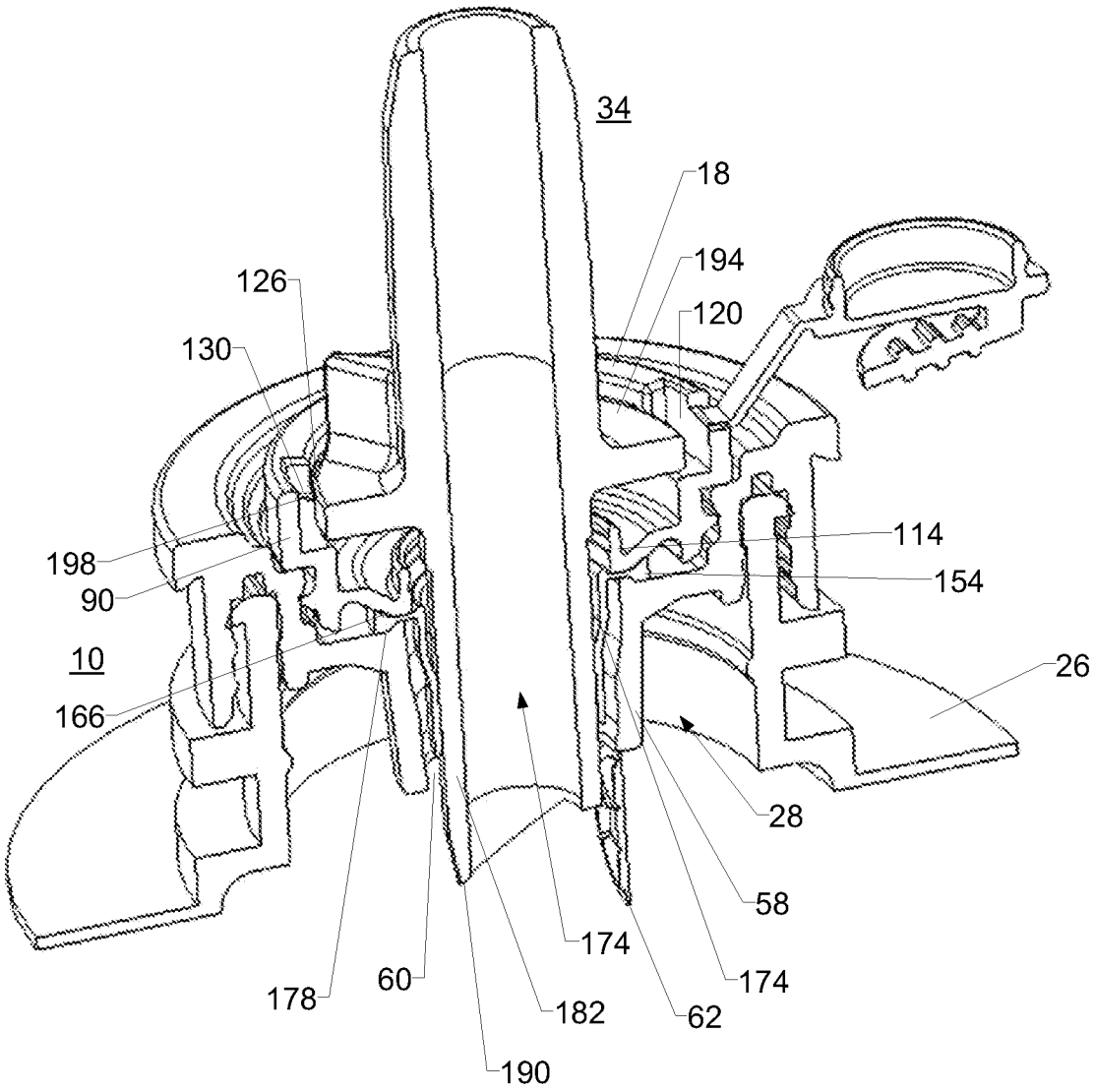
FIG. 4 illustrates another cross-sectional isometric view of the closure assembly, spout, and piercer of FIG. 2 according to an embodiment of the present technology.

FIG. 4 is a cross-sectional view of the piercer 34 inserted into the assembly 10 to withdraw fluid contents from the container. With respect to FIGS. 3 and 4, the piercer 34 is aligned above the passageways 60 and 174 and lowered into the assembly 10 such that the tab(s) 198 on the flange 194 of the piercer 34 is/are aligned with the gap(s) 120 between the bayonet fittings 118 on the retention member 18 until the outer flange 194 of the piercer 34 engages the first inner flange 94 of the retention member 18. As the piercer 34 is inserted into the assembly 10, the point 190 of the piercer 34 penetrates the bottom membrane portion 178 of the valve 154 and the membrane 62 of the housing 14 and goes into the passageway 28 of the spout 26. The flexible, resilient bottom membrane portion 178 of the valve 154 forms a seal around the body 182 of the piercer 34 and the membrane 62 forms a flap that hinges off a portion of the bottom end of the third cylindrical wall 58 of the housing 14.

As the piercer 34 is inserted into the housing 14, the inner cylindrical wall 114 of the retention member 18 can center and guide the piercer 34 toward the center of the passageway 174 of the valve 154. Once the outer flange 194 of the piercer 34 engages the first inner flange 94 of the retention member 18, the user twists and locks the piercer 34 by rotating the flange 194 of the piercer 34 such that the tab(s) 198 slide into a corresponding channel 126 of a bayonet fitting 118 on the collar 90. The tab(s) 198 snapably pass under the retaining projections 130, which retain the tab(s) 198 in the channels 126 and lock the piercer 34 in place with respect to the retention member 18. With the piercer 34 locked in place, fluid product can be withdrawn from the flexible container through the piercer 34, which is connected to a line and a pump or vacuum that creates suction in the piercer 34. The seal formed around the piercer body 182 by the valve membrane 178 prevents fluid from flowing from the spout passageway 28 up to and out of the retention member 18.

Figure 5:
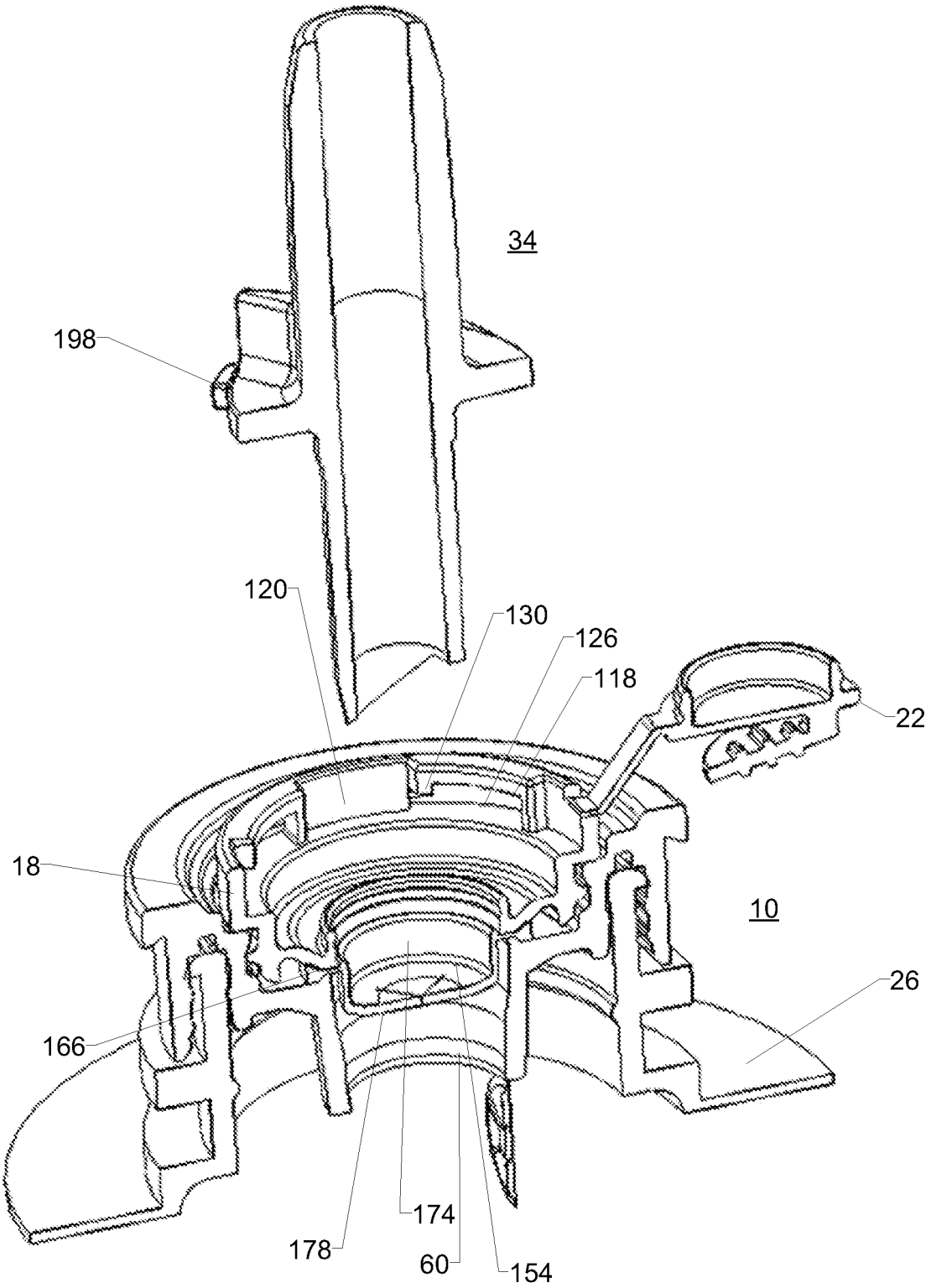
FIG. 5 illustrates another cross-sectional isometric view of the closure assembly, spout, and piercer of FIG. 2 according to an embodiment of the present technology.

With respect to FIGS. 4 and 5, when the user is finished evacuating fluid product from the container with the piercer 34, the user twists the piercer 34 such that the tab(s) 198 on the piercer 34 slide past the retaining projections 130, out of the channels 126 of the bayonet fittings 118, and into the gaps 120 between the fittings 118. In this way, the user unlocks the piercer 34 from the retention member 18. The user can then pull the piercer 34 upward and away from the assembly 10. As the piercer 34 is pulled out of the assembly 10, the bottom portion 178 of the valve 154 closes back up and re-forms a sealed barrier between the passageways 60 and 174. At this point, the user can move the seal cap 22 back to the closed position and seal the assembly 10 if the container still contains fluid that the user would like to withdraw later or to further minimize any residual liquid from within the container from escaping. If the user wishes to extract more fluid form the container, the user can move the seal cap 22 to the open position and re-insert a piercer 34 into the assembly 10 in the manner discussed above. If the container has been emptied, the user can remove the assembly 10 from the spout 26 and discard or recycle the assembly 10, spout 26, and container, or keep the assembly 10, spout 26, and container together and discard or recycle them as a single unit. The piercer 34 can be used once to evacuate a container and then be replaced with a new piercer 34 or it may be used to evacuate multiple similar containers that include the assembly 10 connected thereto.

Figure 6:
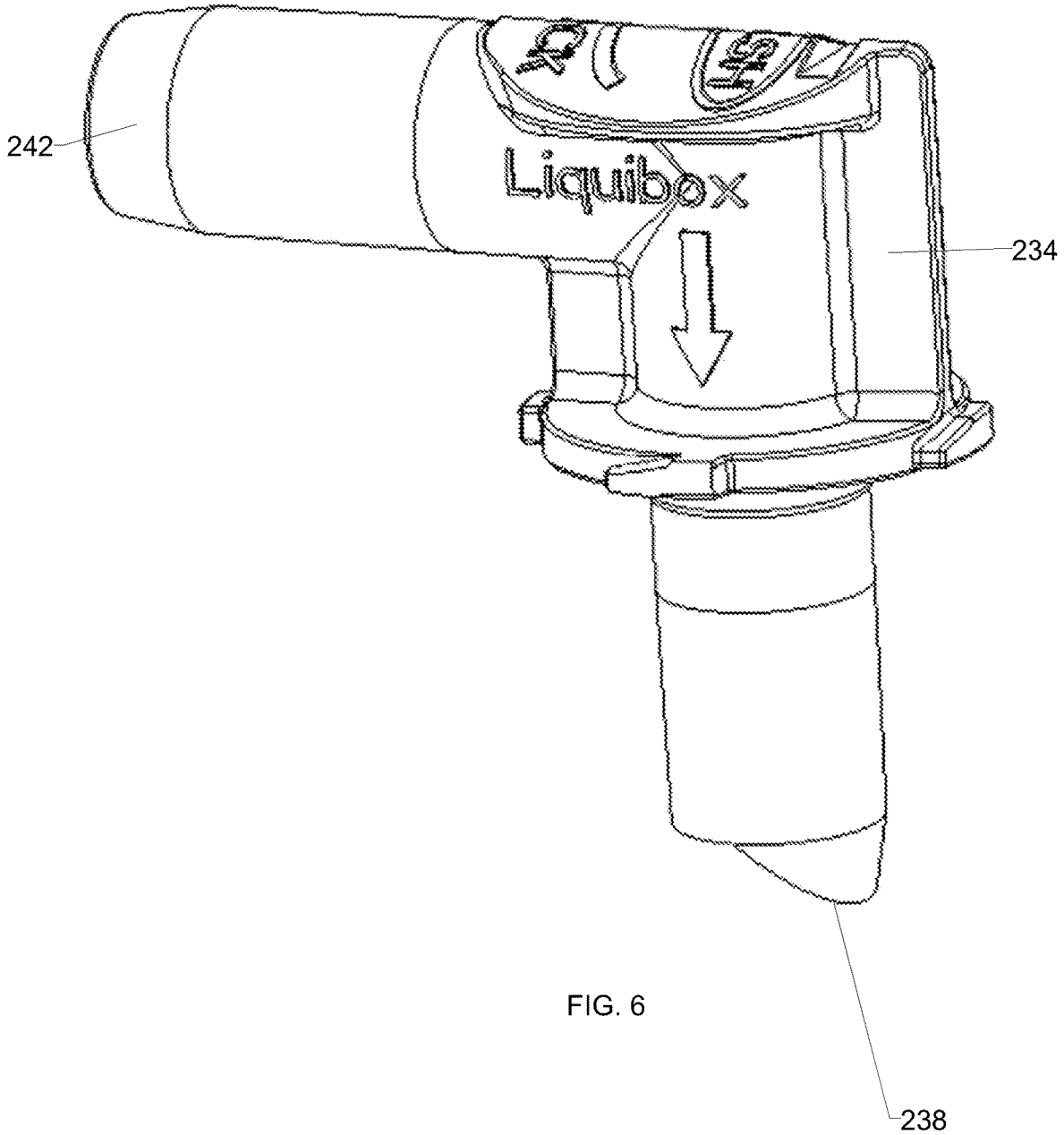
FIG. 6 illustrates an isometric view of another piercer according to an embodiment of the present technology.

FIG. 6 illustrates an alternative piercer 234 that can be used with the assembly 10. The piercer 234 is elbow shaped with the piercing end 238 formed at a right angle with a dispensing end 242. The dispensing end 242 can be tapered and is configured to be connected to a line or tube that is connected to a pump or vacuum and a dispensing station. The piercer 34 is connected to the assembly 10 in the same manner—via a twist locking system—as the piercer 34 of FIGS. 2-5.

The piercer 34, housing 14, retention ring 18, and seal cap 22 can all be made of polymer, such as polyethylene, and are more rigid than the valve 154, which may be made of a flexible material like silicone. In other embodiments, the valve 154 may be made of a thermoplastic elastomer to allow for the assembly 10, spout 26, and container to be recycled as a single item. The piercable membrane 62 of the housing 14 may be made of the same material as the rest of the housing 14, but it is far thinner, which allows the membrane 62 to be pierced and become a flap.

The closure assembly embodiments disclosed herein provide a way to aseptically seal and store fluid in a container until the fluid needs to be extracted. The assembly embodiments also provide for a quick and easy connection of a dispenser system to a bag full of fluid product and for easy dispensing of the fluid product by use of a piercer that pierces a valve membrane and a housing membrane and that can be locked in place with respect to the housing. Because the piercer is a single molded piece and is quick and easy to use, it provides a low cost way to dispense fluid product from multiple bags. By making the housing and its membrane as a single molded piece made of the same material, the housing likewise is cheap and easy to manufacture.

The embodiments disclosed herein are not limited to the specific polymers or materials discussed with respect to those embodiments. Any number of different kinds of polymers having different properties can be used with the embodiments disclosed herein.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A closure assembly for connection to a spout in fluid communication with a container, the closure assembly comprising:

a housing configured to be secured to the spout and including a fluid passageway and a piercable membrane in the fluid passageway, a retention member configured to be secured to the housing, a flexible valve that is positioned in the fluid passageway of the housing and that is secured to the housing by the retention member, wherein the assembly is configured to receive a piercing element that extends into the housing such that the piercing member can pierce the valve and the membrane and the retention member has locking elements that engage the piercing element to lock the piercing element in place with respect to the assembly.

2. The closure assembly of claim 1, further including a seal cap that connects to the retention member to seal the assembly.

3. The closure assembly of claim 2, wherein the seal cap includes a hinged strap that connects the seal cap to the retention member.

4. The closure assembly of claim 1, wherein the piercing element is retained by the retention member with a tab and bayonet fitting connection.

5. The closure assembly of claim 1, wherein the valve forms a seal on the piercer when the piercer is inserted through the valve.

6. The closure assembly of claim 1, wherein the valve is positioned between a sloped wall of the retention member and a ridge that is part of a cylindrical wall of the housing that defines the fluid passageway.

7. The closure assembly of claim 1, wherein the housing includes first and second concentric walls that extend from a top portion and that define an annular channel that receives a wall of the spout.

8. The closure assembly of claim 7, wherein at least one of the first and second concentric walls snapably engages the spout with a projection and detent arrangement in order to secure the spout wall in the annular channel.

9. The closure assembly of claim 7, wherein the retention member includes a, cylindrical wall from which extends a projection that snapably engages a detent in the second concentric wall of the housing in order to secure the retention member to the housing.

10. A system for dispensing fluid, comprising:

a flexible container including a spout connected thereto, the spout being in fluid communication with an interior region of the container;

a housing configured to be mounted to the spout to seal the spout, the housing including a fluid passageway;

a retention member configured to be secured to the housing;

a flexible valve that is positioned in the fluid passageway of the housing and that is secured to the housing by the retention member; and a piercing element having a first end that is configured to puncture the valve and a membrane and a second end configured to be connected to a dispensing element, wherein the piercing element is inserted into the housing such that the first end punctures the membrane and valve and such that the piercing element is locked with respect to the retention member such that fluid can flow from the interior region into the piercing element.

11. The system of claim 10, further including a seal cap that connects to the retention member.

12. The system of claim 11, wherein the seal cap includes a hinged strap that connects the seal cap to the retention member.

13. The system of claim 10, wherein the piercing element is retained by the retention member with a tab and bayonet fitting connection.

14. The system of claim 10, wherein the valve forms a seal on the piercer when the piercer is inserted through the valve.

15. The system of claim 10, wherein the valve is positioned between a sloped wall of the retention member and a ridge that is part of a cylindrical wall of the housing that defines the fluid passageway.

16. The system of claim 10, wherein the housing includes first and second concentric walls that extend from a top portion and that define an annular channel that receives a wall of the spout.

17. The system of claim 16, wherein at least one of the first and second concentric walls snapably engages the spout with a projection and detent arrangement in order to secure the spout wall in the annular channel.

18. The closure assembly of claim 16, wherein the retention member includes a cylindrical wall from which extends a projection that snapably engages a detent in the second concentric wall of the housing in order to secure the retention member to the housing.

* * * * *